US010403458B2

(12) United States Patent
Herdegen et al.

(10) Patent No.: US 10,403,458 B2
(45) Date of Patent: Sep. 3, 2019

(54) SWITCHING UNIT FOR AN ELECTRICAL SWITCH, AND ELECTRICAL SWITCH

(71) Applicant: Siemens Aktiengesellschaft, Munich (DE)

(72) Inventors: Reinhard Herdegen, Amberg (DE); Michael Poles, Radevormwald (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/659,678

(22) Filed: Jul. 26, 2017

(65) Prior Publication Data

US 2018/0061597 A1 Mar. 1, 2018

(30) Foreign Application Priority Data

Aug. 31, 2016 (DE) ..... 10 2016 216 392

(51) Int. Cl.
*H01H 9/44* (2006.01)
*H01H 33/08* (2006.01)
*H01H 9/34* (2006.01)

(52) U.S. Cl.
CPC ..... *H01H 33/08* (2013.01); *H01H 9/44* (2013.01); *H01H 2009/348* (2013.01); *H01H 2205/002* (2013.01)

(58) Field of Classification Search
CPC .. H01H 1/14; H01H 9/38; H01H 9/44; H01H 73/02; H01H 73/18; H01H 1/2041; H01H 9/40

(Continued)

(56) References Cited

U.S. PATENT DOCUMENTS 5,583,328 A 12/1996 Mitsuhashi et al.
6,313,425 B1 * 11/2001 Doughty ..... H01H 9/345 218/149
6,373,014 B1 4/2002 Mitsuhashi et al.
6,480,080 B1 * 11/2002 Asada ..... H01H 1/2058 335/6

(Continued)

FOREIGN PATENT DOCUMENTS

CN 1162830 A 10/1997
CN 1298548 A 6/2001

(Continued)

OTHER PUBLICATIONS

Translation JP2001-093395 (original doc. published Apr. 8, 2001).*

(Continued)

*Primary Examiner* — Edwin A. Leon
*Assistant Examiner* — William A Bolton
(74) *Attorney, Agent, or Firm* — Harness, Dickey & Pierce, P.L.C.

(57) ABSTRACT

A switching unit for an electrical switch is disclosed. In an embodiment, the switching unit includes at least one fixed contact and one moveable contact with a current feed, which in order to close or open the current path are respectively brought into mechanical contact with each other or mechanically or magnetically separated from each other. The switching unit further includes at least one extinguishing plate, which affects an electrical arc created when the electrical contacts are opened. The current feed to the moveable contact is designed such that in the open position it directs the current along the electrical arc in the opposite direction to the current direction of the arc.

16 Claims, 3 Drawing Sheets

(58) Field of Classification Search
USPC ..... 218/149, 103, 110, 5, 15, 18, 30, 31, 34
See application file for complete search history.

(56) References Cited

U.S. PATENT DOCUMENTS

| | | | | |
|---|---|---|---|---|
| 6,791,440 | B2 * | 9/2004 | Harmon | H01H 1/205 335/16 |
| 7,718,908 | B2 * | 5/2010 | Mruthunjaya | H01H 1/226 200/244 |
| 7,948,336 | B2 * | 5/2011 | Park | H01H 1/2041 335/16 |
| 2012/0152718 | A1 * | 6/2012 | Grumel | H01H 1/2058 200/5 B |
| 2015/0129551 | A1 * | 5/2015 | Jang | H01H 9/342 218/149 |
| 2015/0243458 | A1 * | 8/2015 | Britz | H01H 1/2058 218/25 |

FOREIGN PATENT DOCUMENTS

| | | | |
|---|---|---|---|
| CN | 102360972 | A | 2/2012 |
| CN | 104167340 | A | 11/2014 |
| DE | 69315384 | T2 | 4/1998 |
| DE | 102014006494 | A1 | 11/2015 |
| JP | 2001093395 | A | 4/2001 |

OTHER PUBLICATIONS

Translation of DE102014006494 (Original doc. published Nov. 12, 2015).*
Extended European Search Report dated Jan. 31, 2018.
German Office Action 2016P16489DE dated Jul. 6, 2017.
Office Action for Chinese Patent Application No. 201710755410.0 dated Sep. 5, 2018.

* cited by examiner

SWITCHING UNIT FOR AN ELECTRICAL SWITCH, AND ELECTRICAL SWITCH

PRIORITY STATEMENT

The present application hereby claims priority under 35 U.S.C. § 119 to German patent application number DE 102016216392.2 filed Aug. 31, 2016, the entire contents of which are hereby incorporated herein by reference.

FIELD

At least one embodiment of the invention generally relates to a contact system for an electrical switch and to an electrical switch having such a contact system.

BACKGROUND

When current-carrying contacts in electrical switches are opened, electrical arcs are formed. For example, an arc is formed when current-carrying contacts open in the event of a short-circuit. Arcs cause burning of the contacts, which consist mainly of silver and are therefore expensive. If an electrical arc is not extinguished quickly enough, a great deal of energy flows through the protective device, the power cables and the devices that need to be protected. This leads to thermal overload and in some cases even to the destruction of current-carrying and adjacent parts of an electrical circuit.

To extinguish electrical arcs, extinguishing plates are typically used, which split the arc into a plurality of sections and cool it, so as to extinguish it faster overall. During the current flow of the arc, a magnetic field is generated which drives the arc in the direction of the extinguishing plates, where it is then extinguished.

Previously, extinguishing plates made from ferromagnetic materials have been used in order to accelerate the extinguishing process.

SUMMARY

At least one embodiment of the invention specifies a switching unit in which the extinguishing process is accelerated by additional magnetic forces.

At least one embodiment of the invention is directed to a switching unit for an electrical switch. Advantageous configurations of the switching unit are specified in the claims. At least one embodiment of the invention is directed to an electrical switch. Advantageous configurations of the electrical switch are specified in the claims.

The switching unit for an electrical switch according to at least one embodiment of the invention comprises at least one fixed contact and one moveable contact with a current feed to the moveable contact, which in order to close or open the current path are respectively brought into mechanical contact with each other or mechanically or magnetically separated from each other, wherein the switching unit further comprises at least one extinguishing plate, which affects an electrical arc created when the electrical contacts are opened, wherein the current feed is designed such that in the open position it directs the current along the electrical arc in the opposite direction to the current direction of the arc.

The electrical switch according to at least one embodiment of the invention comprises a switching unit according to at least one embodiment of the invention and a handle, wherein the handle activates the switching unit to close or open the current path.

BRIEF DESCRIPTION OF THE DRAWINGS

The properties, features and advantages of the present invention described above and the manner in which they are achieved will become clearer and more comprehensible in conjunction with the following description of the example embodiments, which are explained in more detail in connection with the figures.

DETAILED DESCRIPTION OF THE EXAMPLE EMBODIMENTS

Figure 1:
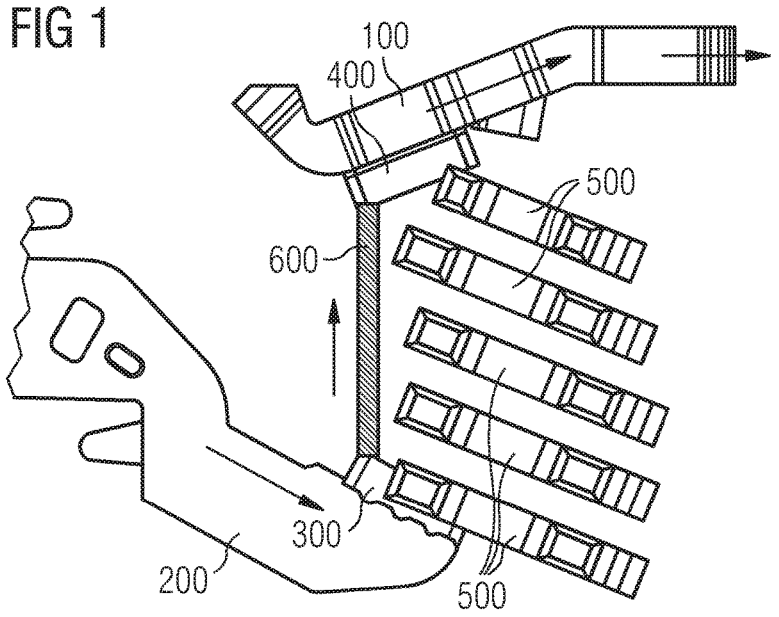
FIG. 1 shows a typical switching unit consisting of a moveable contact and a fixed contact, and electrical arc.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The switching unit for an electrical switch according to at least one embodiment of the invention comprises at least one fixed contact and one moveable contact with a current feed to the moveable contact, which in order to close or open the current path are respectively brought into mechanical contact with each other or mechanically or magnetically separated from each other, wherein the switching unit further comprises at least one extinguishing plate, which affects an electrical arc created when the electrical contacts are opened, wherein the current feed is designed such that in the open position it directs the current along the electrical arc in the opposite direction to the current direction of the arc.

An advantage of this arrangement is that the extinguishing process is accelerated by an additional magnetic force. In the open position of the switching unit the current is directed in the opposite direction to the current direction of the arc, causing the arc to be driven in the direction of the extinguishing plates by the magnetic field of the current conductor. Due to the repulsive forces between the arc and the current feed to the moveable contact, the arc is moved even faster in the direction of the extinguishing plates. The arc therefore has larger contact surfaces with the extinguishing plates and is thereby better cooled by the extinguishing plates. As a further consequence, the extinguishing process is accelerated, the flow rate reduced and the safety of the shutdown process in the event of short-circuits is increased.

In one design of at least one embodiment, the current feed is designed such that in the open position it directs the current substantially parallel to the electrical arc.

In one design of at least one embodiment, the moveable contact comprises a contact arm and a contact piece and the current feed is designed such that in the open position it extends substantially parallel to the electrical arc.

In a further design of at least one embodiment, the switching unit additionally comprises an insulated section, which electrically insulates the current feed from the electrical arc.

In a further design of at least one embodiment, the current feed is arranged in the immediate vicinity of the electrical arc, so that the electrical arc extends as close as possible to the current feed.

In a further design of at least one embodiment, the contact arm is mounted such that it can rotate about a pivot point D and is pivoted about said pivot point D in order to close or open the current path.

In a further design of at least one embodiment, the current feed comprises a semi-circular shaped section, which in the open position extends substantially parallel to the electrical arc.

In a further design of at least one embodiment, the current feed is designed from solid, current-conducting material or as a current-carrying stranded wire which is securely installed in the insulated section.

The electrical switch according to at least one embodiment of the invention comprises a switching unit according to at least one embodiment of the invention and a handle, wherein the handle activates the switching unit to close or open the current path.

In one design of at least one embodiment, the switching unit is arranged in a pole cartridge.

In a further design of at least one embodiment, the electrical switch is a circuit breaker, a transmission line switch, a motor protection switch, an electrical contact, a DC voltage switch or an ACB (air circuit breaker).

BRIEF DESCRIPTION OF THE DRAWINGS

The properties, features and advantages of the present invention described above and the manner in which they are achieved will become clearer and more comprehensible in conjunction with the following description of the example embodiments, which are explained in more detail in connection with the figures.

Figure 2:
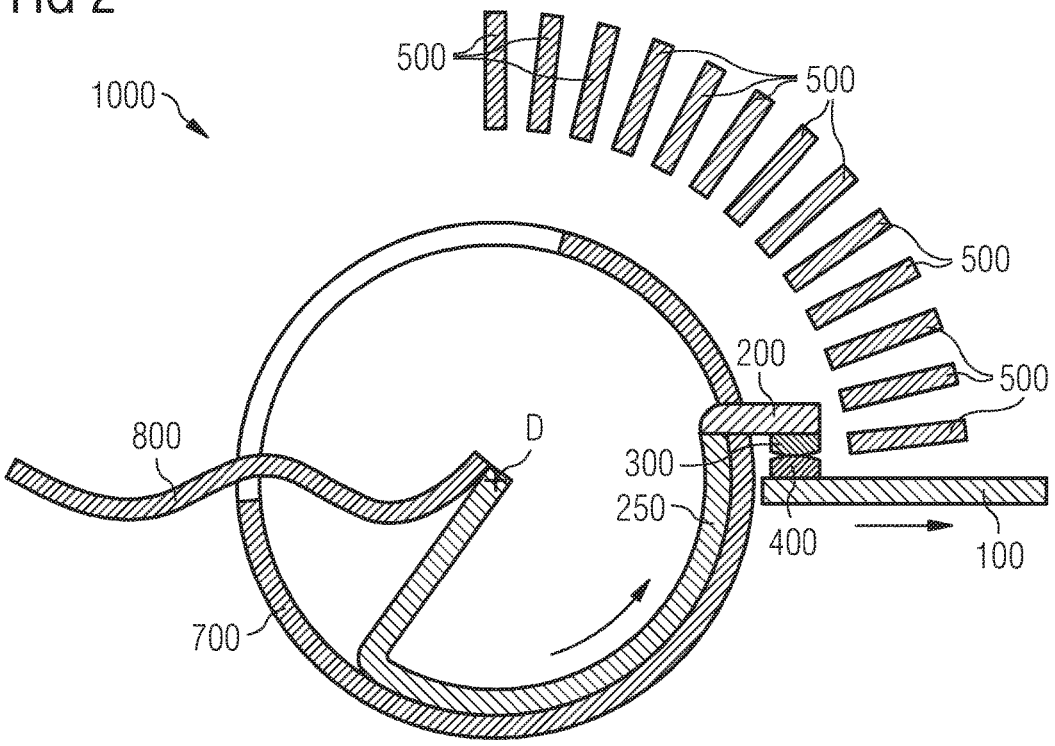
FIG. 2 shows a switching unit according to an embodiment of the invention having a fixed contact and a moveable contact in the closed position.
Figure 3:
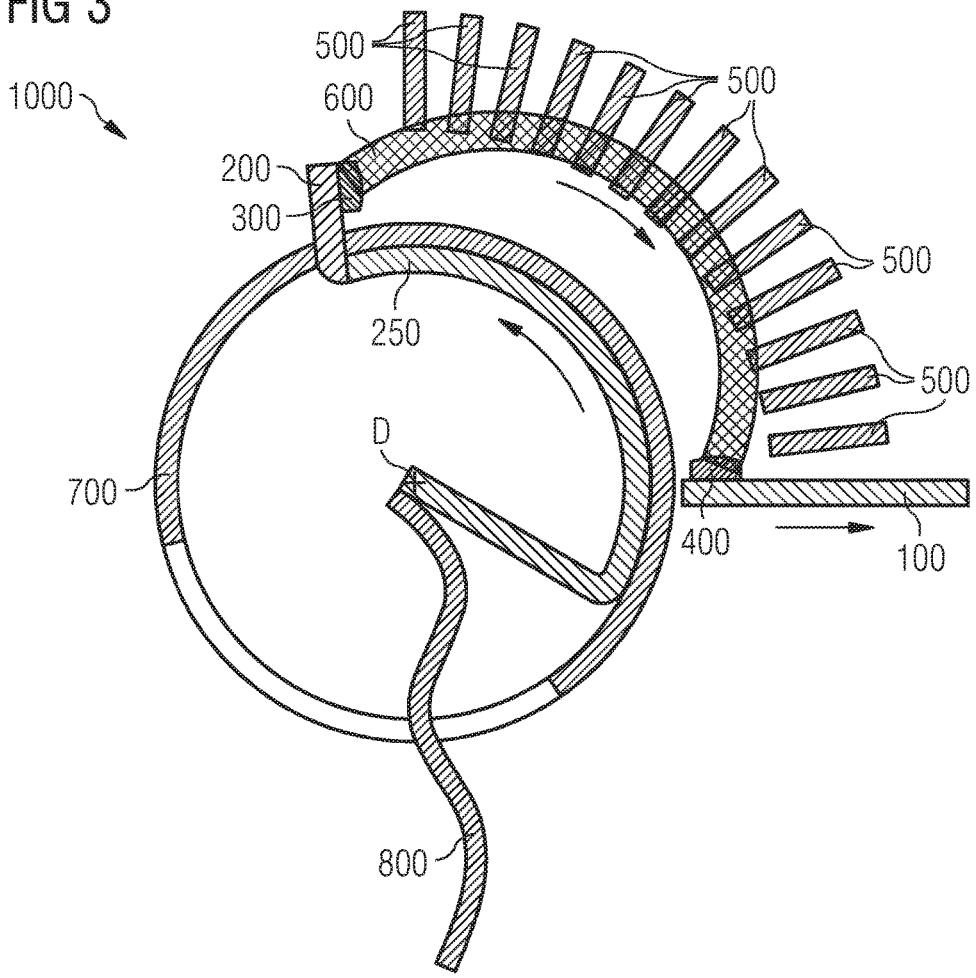
FIG. 3 shows a switching unit according to an embodiment of the invention having a fixed contact and a moveable contact in the open position, and electrical arc.
Figure 4:
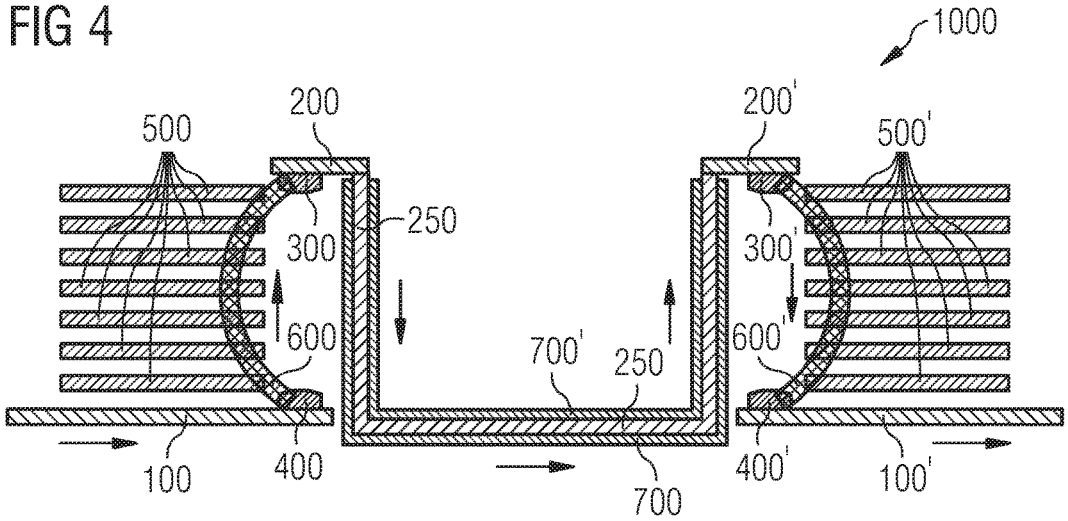
FIG. 4 show an alternative switching unit according to an embodiment of the invention with translational motion of the moveable contact and fixed contact in the open position, and electrical arcs.
Figure 5:
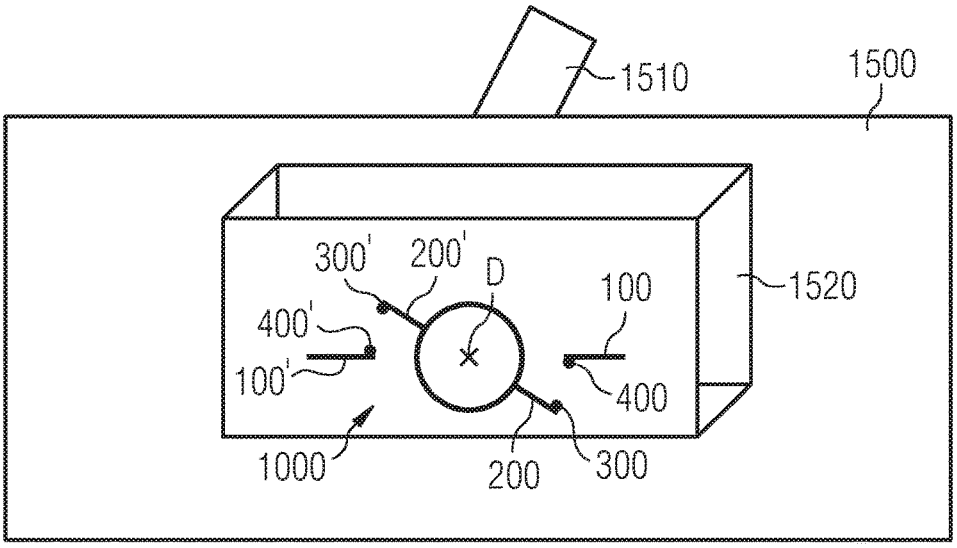
FIG. 5 shows an electrical switch having a switching unit according to an embodiment of the invention.

FIG. 1 shows a typical switching unit consisting of a moveable contact and a fixed contact, and electrical arc;

FIG. 2 shows a switching unit according to an embodiment of the invention having a fixed contact and a moveable contact in the closed position;

FIG. 3 shows a switching unit according to an embodiment of the invention having a fixed contact and a moveable contact in the open position, and electrical arc;

FIG. 4 show an alternative switching unit according to an embodiment of the invention with translational motion of the moveable contact and fixed contact in the open position, and electrical arcs; and FIG. 5 shows an electrical switch having a switching unit according to an embodiment of the invention.

DETAILED DESCRIPTION OF THE EXAMPLE EMBODIMENTS

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

FIG. 1 shows a diagram of a conventional switching unit. The current feed comprises a fixed contact 100 with a contact piece 400, and a moveable contact 200 with a contact piece 300.

Furthermore, extinguishing plates 500 are provided which serve to affect an electrical arc 600 created when the electrical contacts are opened. The current flow is shown by way of arrows and passes through the contact arm 200 of the moveable contact to the contact piece 300, through the arc 600 to the contact piece 400 of the fixed contact 100. Of course, the current flow can also be in the opposite direction to the direction of the arrow.

FIG. 2 shows a diagram of the switching unit 1000 according to the invention. The illustration of FIG. 2 shows the closed position, which enables a current flow. The switching unit 1000 comprises a fixed contact 100, 400 and a moveable contact 200, 300, which in order to close or open the current path are respectively brought into mechanical contact with each other or mechanically or magnetically separated from each other, wherein the switching unit 1000 further comprises at least one extinguishing plate 500 which affects an electrical arc 600 created when the electrical contacts 100, 400: 200, 300 are opened. The current is passed via a current feed 250 to the moveable contact 200 and to the contact piece 400.

The moveable contact 200, 300 comprises a contact arm 200 and a contact piece 300. In the same way, the fixed contact 100, 400 can also consist of a contact arm 100 and a contact piece 400. The two contact pieces 300 and 400 are in mechanical contact, so that the switching unit 1000 is in the closed position and a current flow is possible.

FIG. 2 also shows an insulated section 700 which electrically insulates the current feed 250 from an arc 600 that is created.

FIG. 3 shows the switching unit 1000 according to the invention in the open position. To this end, the fixed contacts 100, 400 are mechanically or magnetically separated from the moveable contacts 200, 300. Under current flow, for example in the event of a short-circuit, an arc 600 is created. This arc 600 forms between the contact pieces 300 and 400. The extinguishing plates 500 are used to split up the arc 600 and extinguish it.

The current feed 250 is designed such that in the open position of the switching unit 1000 said current feed directs the current in the opposite direction to the current direction of the arc 600. The current of the current feed 250 is directed along the electrical arc 600. In accordance with the illustration in FIG. 3, the current feed 250 in the open position extends substantially parallel to the arc 600. The insulated section 700 electrically insulates the current feed 250 from the arc 600.

In FIG. 3 the current flow is shown with arrows. The current flow in the current feed 250 is in the opposite direction to the current flow of the arc 600. This creates magnetic forces that cause a repulsion of the arc 600 in the direction of the extinguishing plates 500. Due to this measure the arc 600 can be extinguished faster than is possible conventionally.

The switching unit 1000 according to an embodiment of the invention in the illustration of FIGS. 2 and 3 is brought into the closed or open position by being mounted such that it can rotate about a pivot point D. To close or open the current path, the moveable contact 200, 300 is pivoted about said pivot point D.

The current feed 250 is arranged such that in the open position it extends substantially parallel to the arc 600.

The current feed 250 to the moveable contact can be electrically contacted via a stranded wire 800 so that the current of the switching unit 1000 flows from the stranded wire 800 to the contact piece 300.

In the open position of the switching unit 1000 according to an embodiment of the invention, the current feed 250 directs the current substantially parallel to the arc 600. In addition, the current feed 250 is arranged in the immediate vicinity of the electrical arc 600, so that the arc 600 extends as close as possible to the current feed 250. In accordance with the illustration of FIG. 3 this means that in an initial state the arc 600 extends as close as possible to the insulated section 700 of the switching unit 1000 and then due to the magnetic forces, moves in the direction of the extinguishing plates 500.

FIG. 4 illustrates an alternative embodiment of the switching unit 1000 according to an embodiment of the invention. The moveable contact 200; 200' is moved translationally to open or close the current path.

In the illustration of FIG. 4 the switching unit 1000 is open and no current can flow directly. When the moveable contacts 200; 200' are opened under current flow, for example in the event of a short-circuit, electrical arcs 600; 600' are formed, which can be extinguished on extinguishing plates 500; 500'. The moveable contacts 200; 200' are electrically and mechanically connected via the current feed 250.

In FIG. 4 the current path is such that in the open position, the current is directed in the opposite direction to the current direction of the arc 600. In the open position of the switching unit 1000 according to an embodiment of the invention, the current feed 250 is designed such that it directs the current substantially parallel to the arcs 600; 600'. This ensures that the arcs 600; 600' are driven in the direction of the extinguishing plates 500; 500'.

Arrows in FIG. 4 also indicate the direction of the current. A current direction opposite to that illustrated is also possible. According to the illustration in FIG. 4 the translational motion of the moveable contacts 200; 200' is a movement upwards or downwards. In the illustration of FIG. 4, to electrically close the switching unit 1000 the moveable contacts 200; 200' can be moved downwards, so that the contact pieces 300; 400, 300'; 400' come into mechanical contact with each other.

FIG. 5 shows a diagram of an electrical switch 1500. The electrical switch 1500 comprises a switching unit 1000 according to an embodiment of the invention and a handle 1510. The handle 1510 activates the switching unit 1000 to close or open the current path. Typically, the handle 1510 is operated by an operator, but a motor operator is also conceivable, which switches the handle 1510 electromechanically. The switching unit 1000 according to an embodiment of the invention can be located in a pole cartridge 1520. Typically, the electrical switch 1500 can comprise a plurality of pole cartridges 1520 for one electrical pole each.

The electrical switch 1500 can be, for example, a circuit breaker, a transmission line switch, a motor protection switch, an electrical contact, a DC voltage switch or else an ACB (air circuit breaker).

If the contacts open in the event of a short-circuit, the moveable contact 200; 200' makes a rotary or a translational movement. An arc 600 is created between the contact pieces 300 and 400, wherein the current flows in the opposite direction to the current flow in the opposite circular or linear section of the current feed 250 of the moveable contact 200; 200'. This causes repulsion forces to be produced between the arc 600 and the current feed 250, which move the arc 600 even faster into the extinguishing plates 500. The arc therefore has larger contact surfaces with the extinguishing plates and is thereby better cooled by the extinguishing plates.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switching unit for an electrical switch, the switching unit comprising:

at least one fixed contact;

at least one moveable contact including a current feed to the at least one moveable contact, wherein, in order to respectively close or open a current path, the at least one moveable contact is respectively brought into mechanical contact with the at least one fixed contact or the at least one moveable contact is respectively magnetically separated from the at least one fixed contact; and a plurality of extinguishing plates in a semi-circular formation, to affect an electrical arc created when the at least one fixed contact and the at least one moveable contact are opened, wherein the current feed is designed such that, in an open position of the at least one moveable contact and the at least one fixed contact, the current feed is configured to direct current along the electrical arc in an opposite direction to a current direction of the electrical arc, wherein the at least one moveable contact includes a contact arm and a contact piece, and the current feed is designed such that, in the open position, the current feed is configured to extend substantially parallel to the electrical arc.

2. The switching unit of claim 1, wherein the current feed is designed such that, in the open position, the current feed is configured to direct the current substantially parallel to the electrical arc.

3. The switching unit of claim 2, wherein the at least one moveable contact includes a contact arm and a contact piece, and the current feed is designed such that, in the open position, the current feed is configured to extend substantially parallel to the electrical arc and the plurality of extinguishing plates.

4. The switching unit of claim 3, further comprising:

an insulated section interposed between the current feed and the plurality of extinguishing plates, to electrically insulate the current feed from the electrical arc.

5. An electrical switch, comprising:

the switching unit of claim 2; and a handle, the handle being configured to activate the switching unit to close or open the current path.

6. The electrical switch of claim 5, wherein the switching unit is arranged in a pole cartridge.

7. The switching unit of claim 1, further comprising:

an insulated section interposed between the current feed and the plurality of extinguishing plates, to electrically insulate the current feed from the electrical arc.

8. The switching unit of claim 7, wherein the current feed is designed from solid, current-conducting material or as a current-carrying stranded wire, securely installed in the insulated section.

9. The switching unit of claim 7, wherein the current feed is arc-shaped and arranged adjacent the electrical arc.

10. The switching unit of claim 1, wherein the current feed is arranged adjacent the electrical arc.

11. The switching unit of claim 1, wherein the contact arm and the current feed are mounted to rotate about a pivot point, and wherein the contact arm and the current feed are pivotable about the pivot point to close or open the current path.

12. The switching unit of claim 1, wherein the current feed includes a semi-circular shaped section, which in the open position, is configured to extend in an arc substantially parallel to the electrical arc and the plurality of extinguishing plates.

13. An electrical switch, comprising:

the switching unit of claim 1; and a handle, the handle being configured to activate the switching unit to close or open the current path.

14. The electrical switch of claim 13, wherein the switching unit is arranged in a pole cartridge.

15. The electrical switch of claim 14, wherein the electrical switch is a circuit breaker, a transmission line switch, a motor protection switch, an electrical contact, a DC voltage switch or an ACB (air circuit breaker).

16. The electrical switch of claim 13, wherein the electrical switch is a circuit breaker, a transmission line switch, a motor protection switch, an electrical contact, a DC voltage switch or an ACB (air circuit breaker).

* * * * *